US006470800B1

(12) United States Patent
Dunson

(10) Patent No.: US 6,470,800 B1
(45) Date of Patent: Oct. 29, 2002

(54) SAFETY SENSOR FOR SCREEN PRINTING FLASH CURE UNIT

(76) Inventor: Casimira Marie Dunson, 204 Oregon Trail, Argyle, TX (US) 76226

( * ) Notice: Subject to any disclaimer, the term of this patent is extended or adjusted under 35 U.S.C. 154(b) by 0 days.

(21) Appl. No.: 09/584,869

(22) Filed: Jun. 1, 2000

Related U.S. Application Data

(60) Provisional application No. 60/138,913, filed on Jun. 1, 1999.

(51) Int. Cl.[7] ..... B41F 23/04
(52) U.S. Cl. ..... 101/487; 101/424.1
(58) Field of Search ..... 101/487, 488, 101/483, 424.1

(56) References Cited

U.S. PATENT DOCUMENTS 4,032,817 A * 6/1977 Richmond ..... 315/149
4,517,893 A 5/1985 Wile et al.
5,050,232 A * 9/1991 Bergman et al. ..... 392/412
5,218,908 A 6/1993 Whitfield
5,249,255 A 9/1993 Fuqua et al.
5,276,978 A * 1/1994 Hopkins et al. ..... 34/48
5,442,261 A * 8/1995 Bank et al. ..... 315/307
5,678,482 A * 10/1997 Daniel et al. ..... 101/129
5,908,000 A 6/1999 Spychalla

* cited by examiner

*Primary Examiner*—Andrew H. Hirshfeld
*Assistant Examiner*—Minh Chau
(74) *Attorney, Agent, or Firm*—Susan F. Johnston

(57) ABSTRACT

Disclosed herein is a safety device for a manual cure unit for use during screen printing. The present safety device includes a proximity sensor, a timer, and a voltage reduction mechanism. A programmable logic controller is used to control the device. The safety device is constructed and designed so that the power supply to the radiation source of the manual cure unit is automatically reduced when an object is detected in the scorch zone of the cure unit for a pre-selected duration of time.

18 Claims, 2 Drawing Sheets

SAFETY SENSOR FOR SCREEN PRINTING FLASH CURE UNIT

CROSS REFERENCES TO RELATED APPLICATIONS

This application claims the benefit of U.S. Provisional Application Ser. No. 60/138,913 filed Jun. 1, 1999.

FIELD OF THE INVENTION

The present invention is in the field of screen printing and curing. The present invention is more particularly in the field of safety devices designed for used in the curing process during screen printing.

BACKGROUND

In the field of screen printing (previously referred to as silkscreen printing), machines known as flash cure units are used to quickly cure ink deposited on a substrate during screen printing. The cure units provide curing radiation via a radiation source such as ultraviolet or infrared lamps. In practice, the substrate being screen printed is typically positioned on a platen of a screen printing machine for proper application of ink. Then the screen printing machine is repositioned so as to place the platen holding the printed substrate under the cure unit to quickly cure the ink. Speedy ink curing is especially important in multi-color printing since a first colored ink must be at least somewhat cured prior to applying another colored ink, in order to avoid mixing and smearing of the various colored inks.

Screen printing cure units are categorized as automatic systems and manual units. As used herein the term "automatic" refers exclusively to the fact that the cure unit is controlled by the screen printing apparatus. For example, some automatic systems are designed so that voltage is increased to the cure unit upon a particular indexing positionment of the printing apparatus and then the voltage supplied to the cure unit is automatically reduced upon an alternative indexing positionment of the printing apparatus. In contrast, a "manual" cure unit is not controllably connected to the screen printing apparatus. A manual cure unit is supplied with a continuous single-voltage power supply and emits a constant flow of curing radiation. For clarity, the categorization of a cure unit as being automatic or manual is independent of whether the screen printing apparatus is a type which is automatically indexing or repositioning or of a type which must be manually repositioned by an operator.

Operators of screen printing equipment have encountered the problem of the cure unit applying heat to a printed substrate for too long of a period. The application of too much heat firstly results in scorching of the substrate. But the most dangerous risk posed is the pervasive risk of ignition of the substrate, thus posing a real danger to the entire work facility.

While safety devices have been incorporated into automatic screening/curing systems, no safety device has heretofore been offered for use with a traditional manual cure unit. Manual ink curing inherently poses a higher risk of ignition than does automatic curing. A screen printing operation using manual curing involves intermittent periods where the cure unit is not being used to cure deposited ink, yet it is emitting a full stream of curing radiation. Additionally, manual curing is often used in retail stores or small home-based shops where articles such as T-shirts are custom printed. In practice, the workspace devoted to the printing operation is often small and cluttered. It has been found that foreign objects are more likely to inadvertently enter into the dangerous scorch zone of the stream of radiation emitted from a manual cure unit than with an automatic cure unit. Accordingly, there is a need in the art for a safety device to prevent scorching and ignition of printed substrates and foreign objects from manual cure units.

Automatic screen printing systems incorporating automatic cure units have been designed to incorporate safety means for preventing excessive application of heat to the printed substrate during curing. U.S. Pat. No. 5,249,255 (Fuqua) discloses a similar printing system equipped with a safety time limit switch that causes the high voltage supplied to the cure unit to be reduced to a much lower voltage after the cure unit has been operated at its high voltage for a predetermined maximum amount of time. Such safety means regulated by the length of time that the cure unit has been operated between cure cycles would not be suitable for a manual cure unit since a manual cure unit is powered by a constant flow of electrical power and has a constant output of radiation.

U.S. Pat. No. 4,517,893 (Wile) discloses a printing system with an automatic cure unit designed so that the heating component of the cure unit is automatically retracted away from the printed substrate if the operator fails to index the screen printing apparatus within a certain period of time from the previous indexing of the screen printing apparatus. This requires a timer that is actuated and reset upon each indexing of the printing machine. Such safety means would not be suitable for a manual cure unit since a manual cure unit is not controllable by the movement of the screen printing apparatus.

U.S. Pat. No. 5,218,908 (Whitfield) discloses a manual cure unit for curing a printed ball cap. This particular manual cure unit is equipped with a slideable tray upon which the ball cap is positioned during curing. The manual cure unit is adapted so that the tray engages to actuate a timer when the operator slides the tray and cap inwardly toward the lamp. Upon reaching the maximum pre-selected time period, the timer actuates a lever to push the tray away from the heat lamps. A manual cure unit having such engaging and actuating parts would be expensive and would deleteriously limit the possible uses of manual cure units. The requirement of contacting and positioning the workpiece on a component of the cure unit is not suitable for high-volume screen printing and curing systems where the manual cure unit is used as an integral part of a multi-color printing process.

In light of the above, it would be desirable to provide a new safety device for ensuring that a manual cure unit does not emit an excessive amount of radiation onto a substrate during curing. Such safety device should be suitable for use with a manual cure unit during high volume multi-color screen printing processes. It would be further desirable for such safety device to be operative without requiring any operator action between curing each item. It would be even further desirable for such safety device to be operative without any contact between the printing machine and the cure unit or between the printed substrate and the cure unit. Further still, it would be desirable for such safety device to operate while the cure unit remains in a static position, without any pivoting or retracting motion being required. Such a safety device would be suitable for use with the traditional free-standing, rigid manual cure units widely used in the screen printing industry. Each of the objects of the present invention is to provide a safety device having these desirable features and benefits.

SUMMARY OF INVENTION

The present invention comprises a safety device for use with a manual cure unit during a screen printing process. The safety device is useful in conjunction with a cure unit that has a radiation source that emits a constant stream of radiation defining a scorch zone. The radiation source is powered by a continuous supply of electric current having a voltage. The present safety device comprises the following components:

a) a proximity sensor positionable at a location proximate the scorch zone, said proximity sensor having a capability to detect the presence of an object disposed in the scorch zone when positioned at said location, and wherein said proximity sensor is adapted to provide a continuous current through an output line while detecting an object in the scorch zone;

b) a voltage reduction mechanism interruptably connectable to the continuous supply of electric current of the cure unit and adapted to reduce said voltage upon actuation, wherein said mechanism actuates upon receiving current through an input line to said mechanism; and c) a timer receivably connected to said output line of said proximity sensor and providingly connected to said input line of said voltage reduction mechanism, wherein said timer is programmable to measure the duration of time that current is continuously received from said output line of said proximity detector and, upon measuring a pre-selected maximum safe cure time, to provide a current to said input line of said voltage reduction means, thereby causing said voltage to be reduced.

In an alternative embodiment of the present safety device, the voltage reduction mechanism is substituted with an alarm so that the safety device is useful to alert the print operator to manually remove the object from the scorch zone. The most preferable embodiment of the present safety device comprises both a voltage reduction mechanism and an alarm for optimum benefits.

DETAILED DESCRIPTION

The Applicant has developed a safety device that is particularly useful for reducing the scorch and fire hazard from a manual cure unit during a screen printing operation. The safety device of the present invention includes a proximity sensor adapted to detect the presence of a printed substrate, or any other object, within the scorch zone of the stream of radiation emitted from the cure unit. The safety device is constructed so that, upon detecting the presence of a substrate, the proximity sensor triggers a timer that is adapted to actuate a voltage reduction mechanism upon reaching a predetermined maximum safe curing time. The voltage reduction mechanism is adapted to reduce the voltage of the power supplied to the radiation source. With less or no voltage provided to the radiation source of the cure unit, the radiation emitted from the cure unit is reduced and the scorch zone is drawn away from the object, thus eliminating the scorch and ignition hazard. In an alternative embodiment of the present invention, the voltage reduction mechanism is substituted with an alarm designed to alert the printing operator to manually remove the object from the scorch zone. The most preferred embodiment of the present safety device is designed to provide an alarm at an early warning time and then to reduce the voltage of the cure unit if the object still remains in the scorch zone upon reaching the pre-determined maximum safe cure time.

In the safety device of the present invention, the voltage reduction mechanism and alarm are actuated as a direct response to the length of the time that an object is continuously detected in the scorch zone of the stream of radiation, the "object-in-zone" time. No previous safety devices have been constructed to effect a reduction in the cure unit power supply based on this particular process parameter. The object-in-zone time has been found to be a surprisingly improved safety parameter for a safety device for a manual cure unit since it proves effective for eliminating the hazard of ignition of both printed substrates as well as foreign objects that inadvertently enter the scorch zone.

Figure 1:
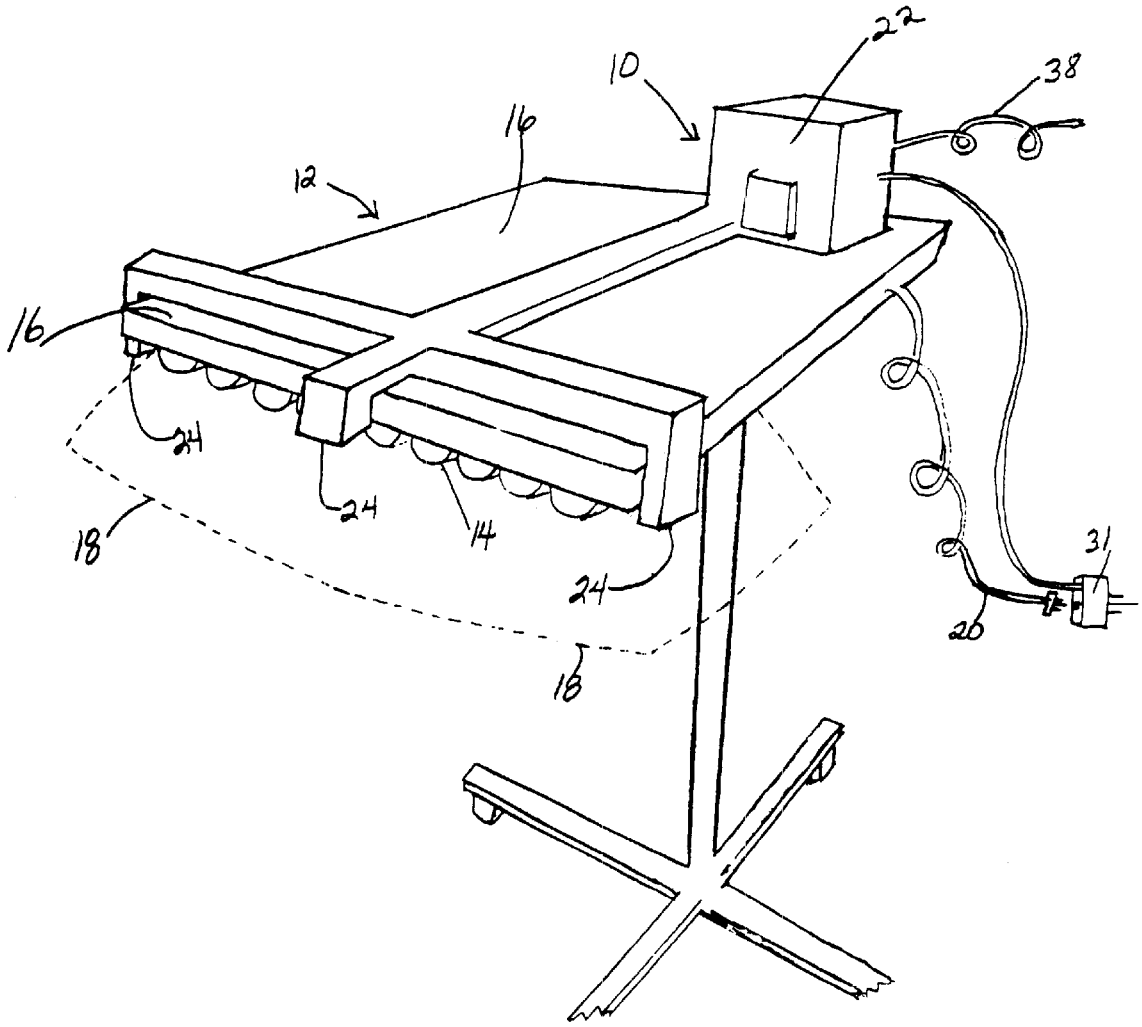
FIG. 1 is a top plan view of the safety device of the present invention positioned atop of a manual cure unit, with the scorch zone of the manual cure unit being illustrated by shadow lines.

The present invention is a safety device for a manual cure unit that is powered by a single-voltage continuous electric power supply and emits a stream of radiation defining a scorch zone proximate the cure unit. Reference is made to FIG. 1, which illustrates the present safety device 10 supportively positioned atop of a manual cure unit 12. The cure unit 12 has a radiation source 14 that is a bank of lamps disposed on the underside of the base 16 of the cure unit 12. The lamps may be disposed longitudinally in a parallel manner for use with a planar substrate or else in a concave or convex manner for use in curing non-planar articles such as ball caps. The scorch zone 18 defined by the radiation emitted from the radiation source is shown in shadow lines in FIG. 1, but is not visible in practice. The continuous supply of electric current is provided to the radiation source 14 through a power cord 20.

It should be understood that while the detector, timer, and voltage reduction mechanism are described herein as being discreet components of the safety device, the timer and voltage reduction mechanism, as well as the electrical lines connecting the components are provided electronically by an electronic programmable logic controller. Thus, the safety device is automatically reset between each cycle. A sufficiently programmed logic controller 22 connected to the proximity sensor and the power supply of the cure unit effects a reduction in the power supply voltage of the cure unit as a function of the output signal from the sensor 24 and the timer. The electrical connections between the components of the present safety device are shown schematically in FIG. 2 and are described below.

The safety device must have a physical construction allowing for the proximity sensor to be positioned proximate the scorch zone and for the voltage reduction mechanism portion of the logic controller to be interruptibly connected to the cord 20 supplying the continuous supply of power to the radiation source 14 of the cure unit 12. FIG. 1 illustrates the preferred embodiment of the safety device 10 having a programmable logic controller 22 having a member extending therefrom to the proximity sensors 24 disposed at positions proximate the scorch zone 18. FIG. 1 shows a safety device equipped with three proximity sensors. But one sensor is sufficient in the present invention.

The present safety device 10 comprises a selective electronic voltage reduction mechanism 28 connectable to the continuous electric power supply 20 of the cure unit radiation source 14 so as to interrupt at least a portion of the electric power supply when actuated. A voltage reduction includes a total interruption of the flow of current. An electronic voltage interruption mechanism that effects a complete shut-off of power to the radiation source is preferred. The electronic voltage reduction mechanism is actuated upon receiving electric current through line 30. As shown in FIG. 1, the voltage reduction mechanism preferably includes a switch 31 that connects the radiation source power cord 20 to an outside power source, such as an AC/DC power supply.

Figure 2:
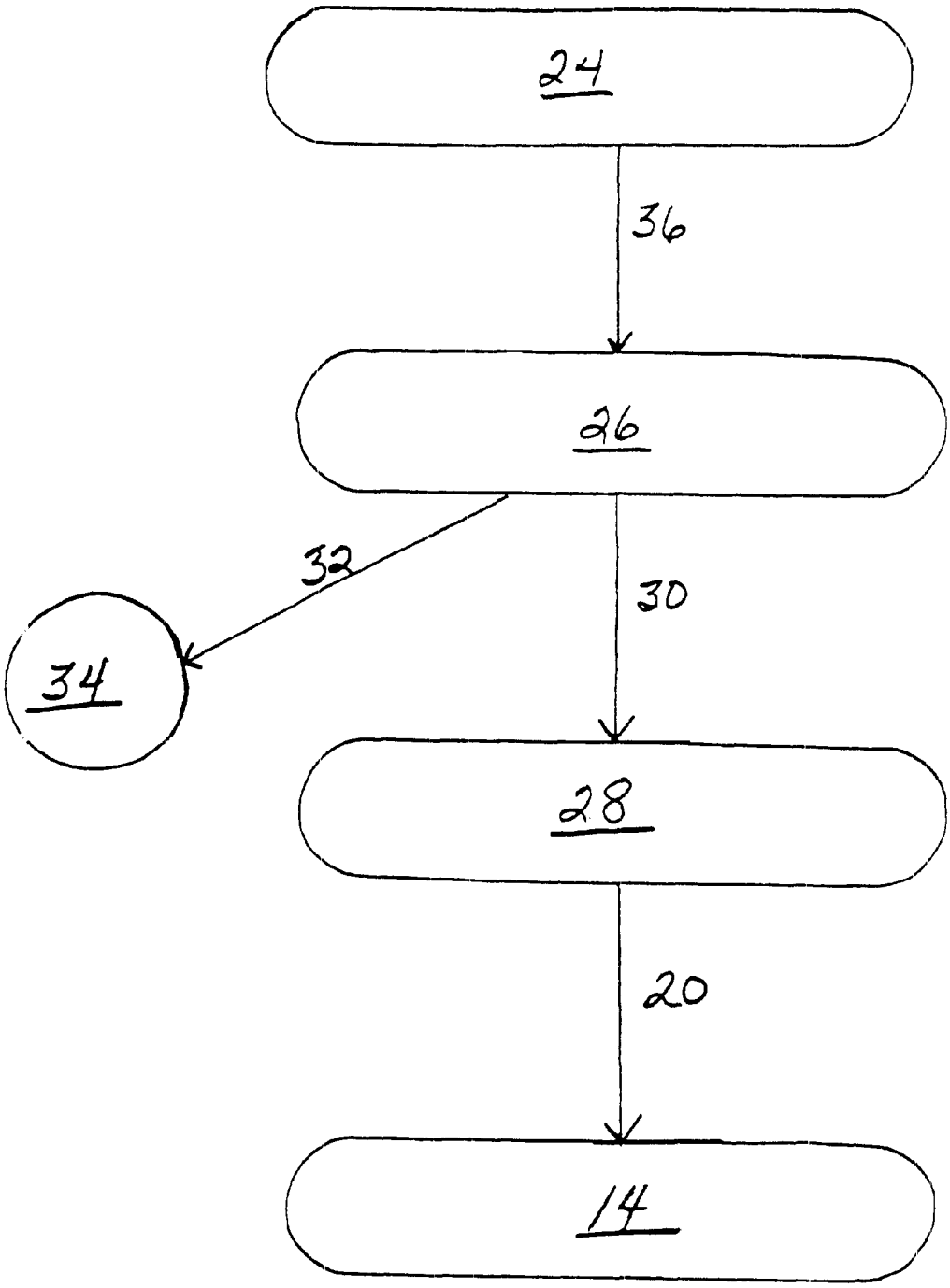
FIG. 2 is a schematic diagram of the present safety device.

The present invention includes an embodiment of the present safety device where electric current flows from the timer 26 through a line 32 to actuate an alarm 34, instead of actuating the electronic voltage reducing mechanism 28. The alarm is intended for the purpose of signaling the operator to manually remove the printed substrate or other object from the scorch zone, thus requiring no reduction of voltage to the cure unit. An alarm is particularly valuable when the radiation source 14 of the cure unit is a battery of lamps having relatively long reheat times. It is preferred that the safety device include both a voltage reducing mechanism 28 and an alarm 24 for optimum safety and curing, as shown in FIG. 2. The alarm is electronically controlled by the logic controller. For convenience, reference to the voltage reducing mechanism made hereinafter should be interpreted to interchangeably refer to a voltage reducing mechanism, an alarm, or a combination of both, unless stated otherwise.

The proximity sensor 24 of the present safety device is a photoelectric sensor capable of detecting the presence of an object in the scorch zone 18, when positioned proximate the scorch zone. The sensor may be any type of photoelectric proximity or motion detector such as a fixed-field sensor having an AC output or any other conductive output that is non-damaging to the printed substrate. An example of a suitable sensor is the EZ-BEAM S18 Series Fixed-Field Sensor commercially available from the Banner Engineering Corporation, USA. The sensor is preferably a light-operate type sensor wherein the interruption of an unbroken beam of light indicates the presence of an object. The sensor should be able to detect the presence of an object positioned in the scorch zone. The scorch zone 18 is defined as the three-dimensional area within the stream of radiation where the radiation has a sufficient wavelength to cure ink deposited on a substrate or scorch or ignite a flammable object. A desired scorch zone for screen printing extends from the radiation source 14 in a range of about 5 to 40 cm. Accordingly, a sensor positioned proximate the radiation source preferably has a detection capability of at least about 40 cm, with a sensing range up to about 50 cm being more preferable. As shown in FIG. 1, the safety device preferably includes a plurality of sensors opposingly positioned to surround the boundaries of the scorch zone and directed in the same general direction of the stream of radiation. However, various other positionments of the sensor such as placement in the center area and directed in the same direction as the stream of radiation, and placement of a sensor to one side of the scorch zone and directed transverse to the stream of radiation are useful examples.

The proximity sensor 24 is electronically connected to an electronic timer 26 and designed to actuate the timer upon detecting the presence of an object via an electric output current in a line 36 connecting the sensor 24 to the timer 26. Such actuating electrical/electronic connections are generally known in the art. The proximity sensor is adapted to provide continuous current through the output line 36 while detecting an object in the scorch zone 18. The timer 26 is programmable to begin measuring time upon receiving current from the sensor and continue measuring time as long as current is continuously received.

The timer 26 component of the present safety device is an electronic programmable actuating timer that is controlled by the output 36 from the proximity sensor 24 and provides an output current that likewise controls the voltage reduction mechanism 28. The timer is programmable so that, upon reaching a pre-selected maximum safe cure time, the timer provides an electric current to line 30 to actuate the voltage reduction mechanism 28 to interrupt the flow of current 20 to the radiation source 14 of the cure unit.

A very simplistic electric scheme is shown in FIG. 2. The particular electrical/electronic connections providing actuation between the sensor 24, timer 26, and voltage reduction mechanism 28 are not critical, as long as the intended function is achieved. A suitable programmable logic controller 22 for providing the timer, alarm, voltage reduction mechanism, and the connection lines therebetween is a logic controller such as one in the series of LOGO! controllers available from SIEMENS AG. Such a controller includes a programmable timer and receives input from the photoelectric sensor and provides output directly to the power supply of the cure unit. The safety device is powered via a power line 38 that is not affected by the voltage reduction to the power supplied through cord 20.

The present invention further includes a manual cure unit powered by a continuous electric power supply and equipped with the present safety device. The safety device may be an integral part of the cure unit or a separate component attached to the cure unit, as shown in FIG. 1, as long as the voltage reducing mechanism of the safety device is controllably connected to the power supply of the cure unit and the proximity sensor is disposed at a position proximate to the scorch zone and is directed toward the scorch zone. The cure unit may include any type of radiation source powered by electric current. Suitable radiation sources include various sources of heat and light such as quartz lamps, infrared lamps, halogen lamps, blown hot air, electric heat element, forced air, electric coils, and combinations thereof. The manual cure unit of the present invention is preferably designed to remain in a static position during operation instead of pivoting or retracting the radiation source away from the object.

The construction of the manual cure unit of the present invention is not dependent upon the type of screen printing machine used in connection with the cure unit. Various types of screen printing machines that can be used with the present manual cure unit include rotary turret style machines, conveyor-style machines, and manual multiple-station and single-station screen printing apparatuses.

The present invention still further includes a process for curing ink deposited on a flammable substrate disposed on a screen printing apparatus using a manual cure unit powered by a continuous electric power supply. The present process is a curing process including positioning the substrate in the scorch zone of the stream of radiation by sufficiently aligning the cure unit and the screen printing apparatus with each other. In the present process, the presence of the substrate in the scorch zone is photoelectronically detected in the stream of radiation. The duration of time that the substrate is continually detected in the scorch zone is measured. When the substrate has been continuously detected in the stream of radiation for a predetermined maximum safe duration of time, the scorch zone is drawn away from the object by reducing or eliminating the power supply to the radiation source of the cure unit.

The present process is preferably conducted using the safety device and manual cure unit combination of the present invention. In the present process, the timer is programmed to actuate the voltage reduction mechanism upon measuring an object-in-zone duration of time selected to be less than the time required for the object to ignite in the scorch zone. The pre-selected time is more preferably less than the time required for the object to scorch in the scorch zone.

The present process preferably includes providing an alerting signal to the operators upon detecting the object in the scorch zone for a pre-determined warning time so that the operator can manually remove the object from the scorch zone without necessitating reducing the voltage supplied to the cure unit. The pre-selected warning time should thus be less than the pre-selected maximum safe time that prompts the reduction in voltage.

The invention has been described in detail with particular reference to preferred embodiments thereof, but it should be understood that variations and modifications can be effected within the spirit and scope of the invention.

What is claimed is:

1. A safety device for use with a manual cure unit during a screen printing process, wherein the cure unit includes a radiation source that is powered by a continuous supply of electric current having a voltage, and wherein the radiation source emits a constant stream of radiation defining a scorch zone, said safety device comprising:

a) a proximity sensor positionable at a location proximate the scorch zone, said proximity sensor having a capability to detect the presence of an object disposed in the scorch zone when positioned at said location, and wherein said proximity sensor is adapted to provide a continuous current through an output line while detecting an object, in the scorch zone;

b) a voltage reduction mechanism interruptably connectable to the continuous supply of electric current of the cure unit and adapted to reduce said voltage upon actuation, wherein said mechanism actuates upon receiving current through an input line to said mechanism; and c) a timer receivably connected to said output line of said proximity sensor and providingly connected to said input line of said voltage reduction mechanism, wherein said timer is adapted to measure the duration of time that current is continuously received from said output line of said proximity sensor and, upon measuring the current output from the proximity sensor for a pre-selected maximum safe cure time, to provide a current to said input line of said voltage reduction means, thereby causing said voltage to be reduced.

2. The safety device according to claim 1 further comprising an alarm that operates upon receiving current through an alarm input line, and further wherein said timer is providingly connected to said alarm input line and said timer is programmable to provide a current to said alarm input line upon measuring a pre-selected warning time.

3. The safety device according to claim 1 wherein said proximity sensor is a photoelectric proximity sensor having a detection capability up to about 50 cm.

4. The safety device according to claim 1 wherein said timer and said voltage reduction mechanism are each provided by, and controlled by, an electronic programmable logic controller.

5. The safety device according to claim 1 comprising a plurality of proximity sensors sufficiently disposed to detect the presence of objects in different areas of the scorch zone.

6. The safety device according to claim 1 wherein said safety device is positionable on the manual cure unit.

7. A safety device for use with a manual cure unit during a screen printing process, wherein the cure unit includes a radiation source that is powered by a continuous supply of electric current having a voltage, and wherein the radiation source emits a constant stream of radiation defining a scorch zone, said safety device comprising:

a) a proximity sensor positionable at a location proximate the scorch zone, said proximity sensor having a capability to detect the presence of an object disposed in the scorch zone when positioned at said location, and wherein said proximity sensor is adapted to provide a continuous current through an output line while detecting an object in the scorch zone;

b) an alarm that operates upon receiving current through an alarm input line; and c) a timer receivably connected to said output line of said proximity sensor and providingly connected to said alarm input line, said timer adapted to measure the duration of time that current is continuously received from said output line of said proximity sensor, said timer adapted to provide a current to said alarm upon measuring the electric current from said proximity sensor for a pre-selected warning time.

8. The safety device according to claim 7 wherein said proximity sensor is a photoelectric proximity sensor having a detection capability up to about 50 cm.

9. A manual cure unit for use during screen printing comprising:

a) a radiation source powered by a continuous supply of electric current having a voltage, and wherein said radiation source emits a constant stream of radiation defining a scorch zone;

b) a proximity sensor positioned proximate said radiation source and directed toward said scorch zone, said proximity sensor having a capability to detect the presence of an object disposed in the scorch zone, and wherein said proximity sensor is adapted to provide a continuous current through an output line while detecting an object in the scorch zone;

c) a voltage reduction mechanism interruptably connected to the continuous supply of electric current of said radiation source and adapted to reduce said voltage upon actuation, wherein said mechanism actuates upon receiving current through an input line to said mechanism; and d) a timer receivably connected to said output line of said proximity sensor and providingly connected to said input line of said voltage reduction mechanism, wherein said timer is adapted to measure the duration of time that current is continuously received from said output line of said proximity sensor and, upon measuring the current output from the proximity sensor for a pre-selected maximum safe cure time, to provide a current to said input line of said voltage reduction means, thereby causing said voltage to be reduced.

10. The manual cure unit according to claim 9 further comprising an alarm that operates upon receiving current through an alarm input line, and further wherein said timer is providingly connected to said alarm input line and said timer is programmable to provide a current to said alarm input line upon measuring a pre-selected warning time.

11. The manual cure unit according to claim 9 wherein said radiation source is a quartz lamp, an infrared lamp, a halogen lamp, blown hot air, an electric heat element, forced air, electric coils, or a combination thereof.

12. In a process for curing ink deposited on a flammable substrate disposed on a screen printing apparatus including a step of providing a cure unit including a radiation source emitting a continuous stream of radiation defining a scorch zone having a size, wherein the radiation source is powered by a continuous supply of electric current having a voltage, and a step of positioning the substrate in the scorch zone by sufficiently aligning the cure unit and the screen printing apparatus with each other, the improvement which comprises:

(a) detecting the presence of the substrate in the scorch zone with a proximity sensor;

(b) measuring the duration of time that the substrate is continually detected in the scorch zone; and (c) upon measuring a predetermined maximum safe duration of time, drawing the scorch zone away from the object by sufficiently reducing the voltage of the electric current supplying the radiation source with a voltage reduction mechanism.

13. The process according to claim 12 wherein the voltage is completely interrupted during the step of drawing the scorch zone away from the object.

14. The process according to claim 12 wherein said predetermined maximum safe duration of time is a time less than the time required for said substrate to ignite in said scorch zone.

15. The process according to claim 12 wherein said predetermined maximum safe duration of time is a time less than the time required for said substrate to become scorched in said scorch zone.

16. The process according to claim 12 wherein the improvement further comprises a step of providing an alert signal upon measuring a predetermined warning duration of time, wherein said warning duration of time is less than said maximum safe duration of time.

17. The process according to claim 12 wherein said aligning is conducted by sufficiently moving the screen printing apparatus so that the substrate is positioned within about 5 to about 40 cm from the cure unit without contacting said cure unit.

18. The process according to claim 12 wherein said curing process is conducted in conjunction with a multi-color screen printing process.

* * * * *